US005743831A

United States Patent [19]

Jakich

[11] Patent Number: 5,743,831

[45] Date of Patent: Apr. 28, 1998

[54] APPARATUS AND METHOD FOR EXERCISING THE LEG

[76] Inventor: Alek Jakich, 2451 N. Sawyer Ave., Chicago, Ill. 60647

[21] Appl. No.: 680,022

[22] Filed: Jul. 15, 1996

[51] Int. Cl.[6] ..... A63B 22/00; A63B 23/04

[52] U.S. Cl. ..... 482/52; 482/79; 482/34

[58] Field of Search ..... 482/52, 79, 142, 482/34, 36, 907; 601/34, 35, 27, 28

[56] References Cited

U.S. PATENT DOCUMENTS

| | | | |
|---|---|---|---|
| 1,664,664 | 4/1928 | Crum | 482/79 |
| 2,638,088 | 5/1953 | Johnson . | |
| 3,472,508 | 10/1969 | Baker et al. . | |
| 3,521,881 | 7/1970 | Schaevitz | 482/142 |
| 4,105,201 | 8/1978 | L'Ecuyer et al. | 482/34 |
| 4,253,661 | 3/1981 | Russel . | |
| 5,158,512 | 10/1992 | Irwin et al. | 482/52 |
| 5,226,865 | 7/1993 | Chin | 482/52 |

FOREIGN PATENT DOCUMENTS 2654639 5/1991 France .

OTHER PUBLICATIONS

"Fit Track" model 5052, Action Products Incorporated.

Arnold Schwarzenegger Encyclopedia of Modern Body Building, p. 489, (1985).

"Balance Beam" p. 29, L.A. Steel Craft Products, (1989).

*Primary Examiner*—Richard J. Apley

*Assistant Examiner*—William LaMarca

*Attorney, Agent, or Firm*—James C. Paschall

[57] ABSTRACT

The invention comprises a product of and a method of using a raised platform which preferably has two pairs of sides. One pair of sides converge to define a protrusion and to accommodate feet which are turned inwardly; the other pair of sides recede to define an opening and to accommodate feet which are turned outwardly. Each side in a pair of sides is separately configured so the user can place his foot on the platform when the foot is turned inwardly or outwardly. The platform is supported above a lower surface by legs.

19 Claims, 2 Drawing Sheets

PRIOR ART

APPARATUS AND METHOD FOR EXERCISING THE LEG

TECHNICAL FIELD

This invention is directed to an apparatus and method for exercising the leg. The device aids specifically in the exercise of the calf muscle.

BACKGROUND

Bodybuilders comprise an array of people, ranging from those who are maintaining fitness to those who compete in bodybuilding contests. To develop the muscles through exercise, some muscles require more exercise than others. This often depends on the location of the type of muscle targeted for development. Leg muscles are more difficult to strengthen than other muscle groups because the legs are typically already well developed through everyday usage, such as walking. The lower leg muscle, specifically the calf muscle, generally indicated as 8 in FIG. 1, requires more intense, concentrated exercise to strengthen.

A conventional way of exercising the lower leg is by performing what is commonly called calf raises or toe raises. This exercise involves standing on a floor or surface and elevating the heels off the ground to the highest extension while maintaining the forefeet on the floor. The feet are then relaxed, allowing the heels to descend to the floor. The exercise is repeated to achieve a desired level of muscle fatigue.

While performing the calf-raise exercise, the floor prevents the feet from realizing the full range of motion during descent. A conventional, raised platform 10 shown in FIGS. 1–8 is often used to facilitate a full range of foot motion while performing the calf-raise exercise. A straight-sided, raised platform 10 of the prior art simply comprises a bar 10*a* raised off the ground 12 by support legs 10*b*, 10*c*. The side 10*d* of the bar 10*a* which faces the user is straight.

The straight-sided, raised platform 10 is typically used as shown in FIGS. 1–3. The user 14 mounts his feet 16*a*, 16*b* on the platform 10*a* by placing his forefeet 18*a*, 18*b* up onto the raised platform 10*a* but leaves his heels 20*a*, 20*b* off the platform 10*a*, unsupported as shown in FIG. 2. The feet are typically situated perpendicular to the straight side 10*d* of the platform 10. The user 14 then lowers his heels 20*a*, 20*b* down below the bar 10*a* to a low point as shown in FIG. 3 and then extends his feet 16*a*, 16*b*, so that the heels 20*a*, 20*b* are elevated to a point above the platform 10. The forefeet 18*a*, 18*b* are maintained on the platform 10 while the rest of the feet enjoys the full range of motion. This exercise is repeated in several iterations until the user 14 is satisfied with the amount of muscle exertion.

A user can perform this exercise with the straight-sided, raised platform in several different foot postures. The conventional posture entails the user standing on the platform to perform the exercise. In this posture, the user can perform the exercise with just his body weight. Alternatively, the user can place a weight on his shoulders or hold it in his hands while performing the exercise, for additional muscle exertion.

A user can also use the straight sided raised platform while seated. In this posture, which is not illustrated, the user sits down on a stool or chair and the straight sided raised platform is stationed squarely on the floor in front of the user. The forefeet are placed on the raised platform to commence the exercise. This method does not involve lifting the user's bodyweight because the user is seated. Often the user will place an additional weight on his knees when performing the exercise in the sitting posture.

Another seated posture makes use of a machine which is not illustrated. The user is seated but the straight-sided, raised platform on which the feet rest is stationed not on the floor but is vertically suspended or supported above the floor. In this posture, the platform actually resembles pedals more than a platform. The user sits with his legs parallel to the floor, his forefeet on or against the platform pedal, and the user pushes the platform pedal forward by extending his feet. He then relaxes his feet allowing the pedal to return to the original position and the exercise is repeated in a like fashion.

As noted, these foregoing postures generally involve the user placing his feet perpendicular to the straight side of the raised platform to perform the exercise. However, many bodybuilders seek to develop the inner and outer ridges of the calf muscles to obtain a fuller muscle definition.

To concentrate the exercise on the inner ridge 8*a* of the calf muscle 8 while performing calf raises, one can turn his feet 16*a*, 16*b* inwardly as show in FIGS. 4–6. By positioning the forefeet 18*a*, 18*b* closer together than the heels 20*a*, 20*b*, pressure is predominantly applied to the inner ridge 8*a* of the calf muscle 8, exerting the inner ridge 8*a* of the calf muscle 8 more during the exercise.

The opposite effect is obtained by turning the feet 16*a*, 16*b* outwardly as shown in FIGS. 7 and 8. By positioning the heels 20*a*, 20*b* closer together than the forefeet 18*a*, 18*b*, pressure is predominantly applied to the outer ridge 8*b* of the calf muscle 8 during the exercise. These two variations are used by bodybuilders to fully develop the calf muscles 8.

These variations cause some problems when a straight sided, raised platform 10 is used to provide a full range of foot motion. The problem arises when the feet 16*a*, 16*b* are turned inwardly or outwardly, so they are not positioned perpendicular with the straight side 10*d* of the raised platform 10*a*. When the feet 16*a*, 16*b* are perpendicular to the straight side 10*d*, the forefeet 18*a*, 18*b* are squarely on the bar 10*a* to provide stable support as shown in FIG. 2. However, when the feet 16*a*, 16*b* are turned inwardly as shown in FIG. 6 or outwardly as shown in FIG. 8 the forefeet 18*a*, 18*b* are not squarely on the bar 10*a*, impairing the stability of the user 14.

Two things can happen with the loss of stability. First, the user runs the unsafe risk of loosing his balance and slipping off the platform, which is especially dangerous when the user is burdened with heavy weight. Second, the user's capability of exerting his muscles to the fullest extent is diminished when the feet are unstable. When performing calf raises, the feet are the points from which the exertion of force is concentrated.

SUMMARY OF THE INVENTION

An object of this invention is to provide a stable platform for exercising the leg even when the user turns his feet inwardly or outwardly.

The invention corrects the stability problem inherent in the straight-sided, raised platform. The invention comprises an apparatus for exercising the leg comprising a flat platform with a top surface and a plurality of sides. Two of the sides converge at an angle with respect to each other. Legs brace the platform above a base surface. Preferably, the platform has two pairs of converging sides. One pair of converging sides protrude to accommodate feet which are turned inwardly. Another pair of converging sides recede to accommodate feet which are turned outwardly.

To use the platform one places a first forefoot on a first surface adjacent a first converging side and a second forefoot on a second surface adjacent a second converging side of the pair of converging sides. The user extends the heels of each foot in a direction longitudinally away from the legs of the user while maintaining both forefeet on the surfaces. The user then withdraws the heels of each foot in a direction longitudinally toward the legs of the user while maintaining both forefeet on the surfaces of the platform.

BRIEF DESCRIPTION OF DRAWINGS

A preferred embodiment of the invention is described with the aid of the following figures.

DESCRIPTION OF THE INVENTION

Figure 1:
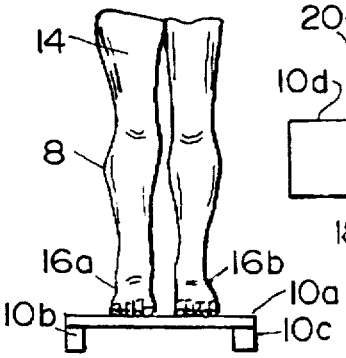
FIG. 1 shows the user on a straight-sided, raised platform of the prior art.
Figure 2:
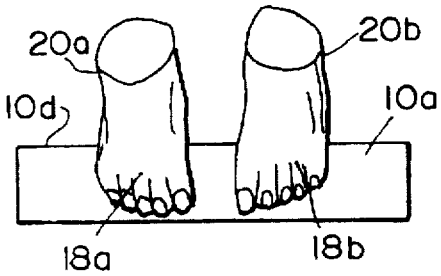
FIG. 2 is a top view of the feet positioning on a straight-sided, raised platform of the prior art.
Figure 3:
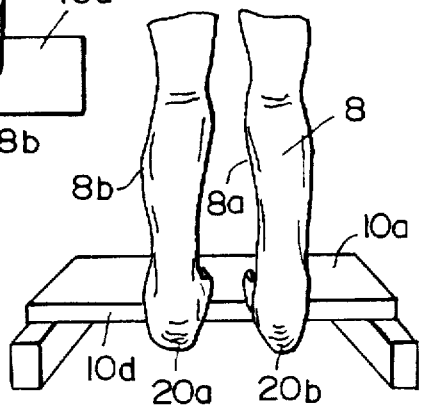
FIG. 3 shows a rear view of FIG. 1 with heel of the user at a descent.
Figure 4:
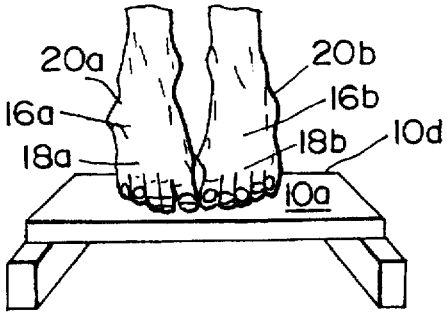
FIG. 4 shows a front view of the feet positioning on a straight-sided, raised platform device of the prior art with the feet turned inwardly.
Figure 5:
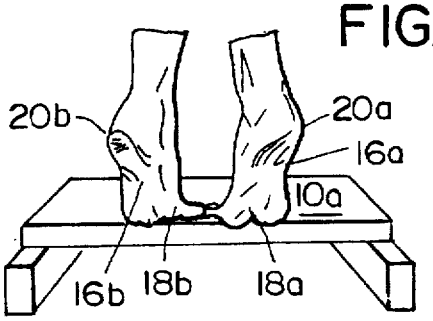
FIG. 5 is a rear view of FIG. 4.
Figure 6:
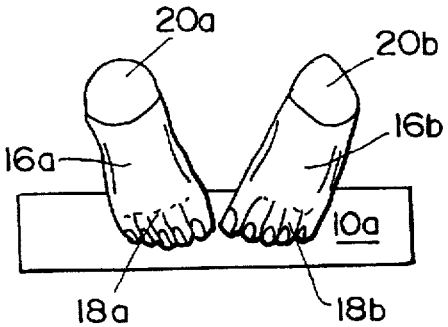
FIG. 6 is a plan view of FIG. 4.
Figure 7:
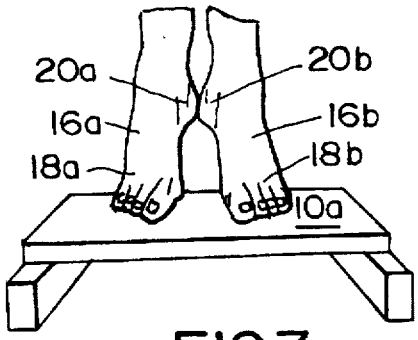
FIG. 7 shows a front view of the feet positioning on a straight-sided, raised platform device of the prior art when the feet are turned outwardly.
Figure 8:
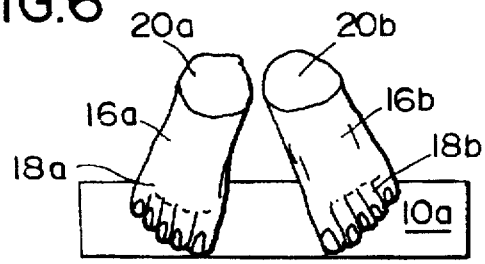
FIG. 8 is a plan view of FIG. 7.
Figure 9:
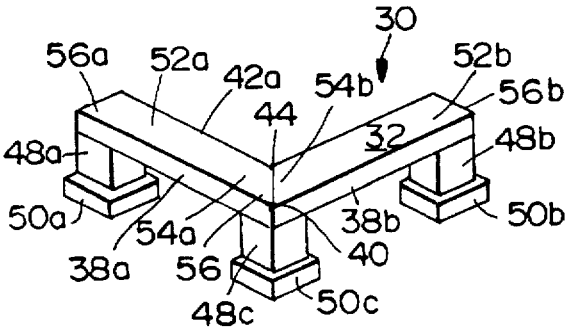
FIG. 9 shows a perspective of the preferred embodiment of the present invention.
Figure 10:
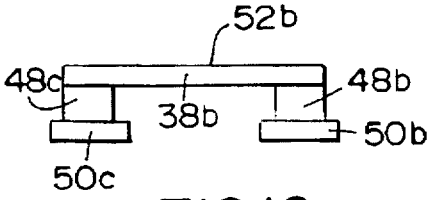
FIG. 10 shows a side elevated view of the invention in FIG. 9.
Figure 11:
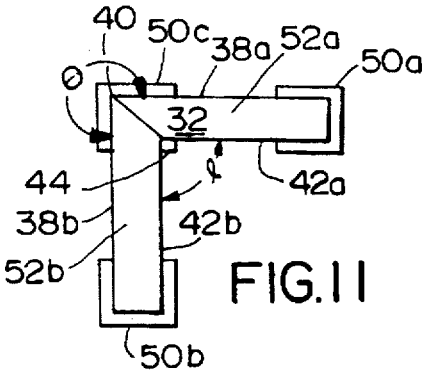
FIG. 11 shows a top view of a preferred embodiment of the invention.

The present invention comprises a flat platform 30 with a top surface 32 and plurality of sides which circumference the top 32. Two of the sides 38*a*, 38*b* converge to extend the top of the platform into a angled protrusion 40. The protrusion 40 is coplanar with the top surface 32 of the platform 30. Two other sides 42*a*, 42*b* of the platform 30 converge to recede the top 32 of the platform 30 to define a triangular opening 44. The opening 44 is also coplanar with the top surface 32 of the platform 30.

The platform 30 preferably comprises two elongated beams 52*a*, 52*b*, each which has the outer sides 38*a*, 38*b* and the inner sides 42*a*, 42*b*, joined ends 54*a*, 54*b* and a free ends 56*a*, 56*b*. The beams 52*a*, 52*b* can be made of any strong material including wood, metal or plastic. The two beams 52*a*, 52*b* are adjoined at their joined ends 54*a*, 54*b* at an angled junction 56. The outer sides 38*a*, 38*b* of the two beams 52*a*, 52*b* converge at the junction 56 to define the angled protrusion 40. The inner sides 42*a*, 42*b* of the two beams 52*a*, 52*b* converge at the junction 56 to define the angled opening 44.

The beams 52*a*, 52*b* are supported or suspended above the floor or ground by use of a plurality of legs, by braces or by its own height. In the preferred embodiment, the platform is supported above the ground by three legs 48*a*, 48*b*, 48*c*. One leg 48*c* is located at the junction 56 of the two beams 52*a*, 52*b*. The other two legs 48*a*, 48*b* are located underneath the beams 52*a*, 52*b* at each free end 56*a*, 56*b*, respectively. A pad or base 50*a*, 50*b*, 50*c* is preferably placed under each leg 48*a*, 48*b*, 48*c*, respectively, to add stability. The legs and the base may be made of any strong material including metal, wood or plastic. The platform must be more than amply sturdy to support the body weight of the user and any additional weight the user may want to hold to increase muscle exertion. The components of the platform 30 are fastened together by any suitable means.

Figure 13:
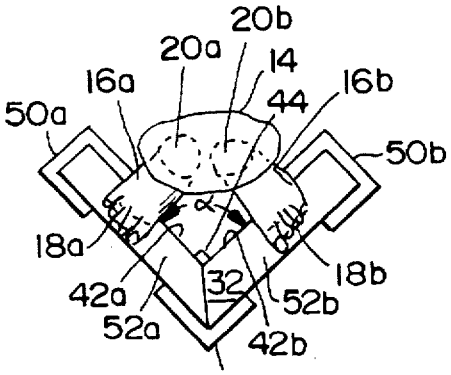
FIG. 13 shows a top view of the feet positioning on the preferred embodiment with the feet turned outwardly.
Figure 15:
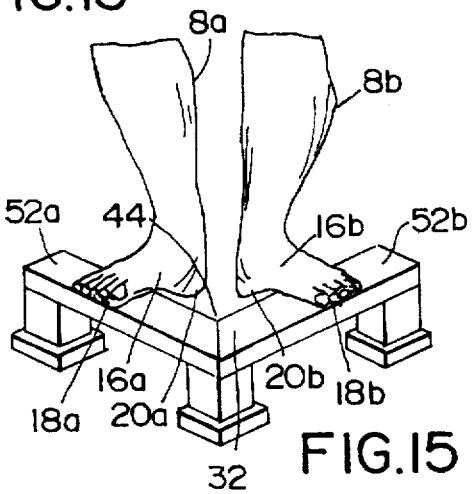
FIG. 15 shows a perspective view of the feet positioning on the preferred embodiment with the feet turned outwardly.

The angled opening 44 is designed to facilitate exercise of the outer ridge 8*b* of the calf muscle. Calf-raise exercises are most effective on the outer ridge 8*b* when performed while the feet 16*a*, 16*b* are turned outwardly, with the heels 20*a*, 20*b* closer together than the forefeet 18*a*, 18*b* as show in FIGS. 13 and 15. To exercise the outer ridge 8*b* with the aid of the platform 30, the angled protrusion 40 is pointed away from the user 14. The user 14 turns his feet 16*a*, 16*b* outwardly and places each forefoot 18*a*, 18*b* on the respective beam 52*b*, 52*a* comprising the angled opening 44. The calf-raise exercise is performed with the heels 20*a*, 20*b* of the feet passing through the triangular opening 44 which is coplanar with the top 32 of the platform 30.

The sides 42*a*, 42*b* of the beams 52*a*, 52*b* which define the angled opening 44 must be sufficiently long and wide to enable the user to stabilize his balance on the top surface 32 of the platform 30. Moreover, the angle $\alpha$ defined by the angled opening 44 must be sufficiently large to permit the user's feet 14*a*, 14*b* which are turned outwardly and positioned perpendicularly with respect to sides 42*a*, 42*b* to pass through the opening 44 without the heels 20*a*, 20*b* of each foot 14*a*, 14*b* contacting the other. The preferred angle $\alpha$ is believed to be 90 degrees.

Figure 12:
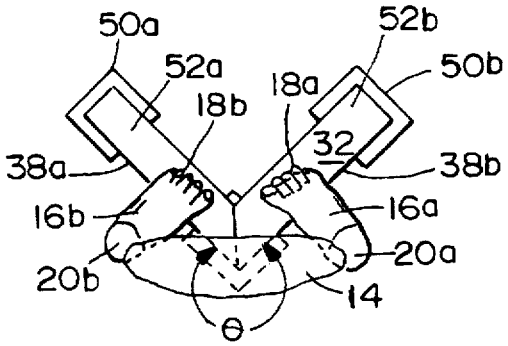
FIG. 12 shows a top view of the feet positioning on the preferred embodiment with the feet turned inwardly.
Figure 14:
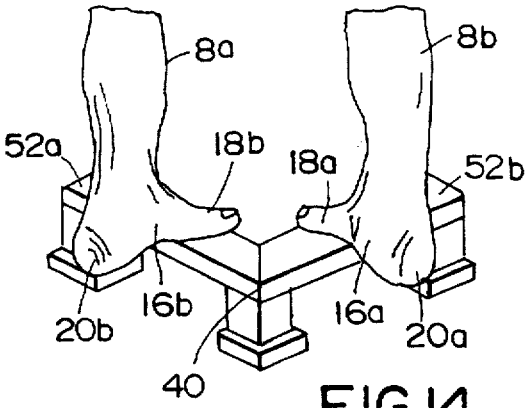
FIG. 14 shows a perspective view of the feet positioning on the preferred embodiment with the feet are turned inwardly.

The angled protrusion 40 is designed to facilitate exercise of the inner ridge 8*b* of the calf muscle 8. Calf-raise exercises are most effective on the inner ridge 8*b* when the feet 14*a*, 14*b* are turned inwardly, with the heels 20*a*, 20*b* farther apart than the forefeet 18*a*, 18*b*. To exercise the inner ridge 8*b* of the calves 8 with the aid of the platform 30, the angled protrusion 40 is pointed toward the user 14. The user turns his forefeet 18*a*, 18*b* inwardly and places each foot 14*a*, 14*b* on the opposing side of the angled protrusion 40 on the beams 52*b*, 52*a*, respectively, as shown in FIGS. 12 and 14. The calf-raise exercise is performed with the heels 20*a*, 20*b* of the feet 14*a*, 14*b* passing through an imaginary plane that is coplanar with the top 32 of the platform 30.

The sides 38*a*, 38*b* of the beams which define the angled protrusion 40 must be sufficiently long and the top surface must be sufficiently wide to enable the user to stabilize his balance. However, the angle $\Theta$ defined by the angled protrusion 40 must be sufficiently small to permit the user's feet 14*a*, 14*b* which are turned inwardly to pass through the imaginary plane coplanar with the top surface 32, while allowing the user's feet 14*a*, 14*b* to remain substantially perpendicular with the beams 52*b*, 52*a*, respectively. It is believed that the preferred angle $\Theta$ defined by the angled protrusion is 270°. The angles $\alpha$ and $\Theta$ defined by the angled opening 44 and the angled protrusion 40, respectively, can be modified by adjusting angular relationship between the inner sides 42*a*, 42*b* and outer sides 38*a*, 38*b* of the beams 52*a*, 52*b*.

Although a preferred embodiment is described and claimed the invention encompasses all variations which fall within the spirit or scope of the appended claims. For example, the platform can be supported or suspended parallel or perpendicular above the ground. In the latter case the platform may be incorporated into a machine. It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of exercising the leg comprising the steps of: providing an apparatus comprising a flat platform with a first top surface and a second top surface, said platform being defined by a plurality of sides including a first side extending along said first top surface and a second side extending along said second top surface, said first side and said second side each having a common end, said first side and said second side converging at an angle with respect to each other at said common ends thereof, said first side and said second side each having free ends opposite to said common ends; a third side and a fourth side, said free end of said first side being adjacent to said third side and said free end of said second side being adjacent to said fourth side; a fifth side and a sixth side, said fifth side being adjacent to said third side and extending toward said second side, and said sixth side being adjacent to said fourth side and extending toward said first side; said first top surface being coplanar with said second top surface to define a plane; and legs for bracing said platform above a base surface;

placing a first forefoot of a user on said first top surface and placing a second forefoot of said user on said second top surface; and extending the heels of each foot in a direction longitudinally away from the legs of the user through said plane while maintaining both forefeet on the first and second top surfaces; and withdrawing the heels of each foot in a direction longitudinally toward the legs of the user back through and away from said plane while maintaining both forefeet on the first and second top surfaces of said platform.

2. The method of claim 1, wherein said first and second sides of said apparatus converge inwardly to define an angular opening.

3. The method of claim 2, wherein said first and second sides of said apparatus approximately define a right angle.

4. The method of claim 2, wherein said angular opening of said apparatus is sufficiently wide to allow each foot of said user to be placed perpendicular to each respective one of said first and second sides of said angular opening.

5. The method of claim 1, wherein said first and second sides of said apparatus converge outwardly to define an angular protrusion.

6. The method of claim 5, wherein said first and second sides of said apparatus approximately define a right angle.

7. The method of claim 5, wherein said angular protrusion of said apparatus is sufficiently narrow to allow each foot of said user to be placed on said platform perpendicular to each respective one of said first and second sides of said angular protrusion.

8. A method of exercising the leg comprising the steps of: providing an apparatus comprising a flat platform with a first top surface and a second top surface, said platform being defined by a plurality of sides including a first side extending along said first top surface and a second side extending along said second top surface, said first side and said second side each having a common end, said first side and said second side converging at said common ends thereof, said first side and said second side each having free ends; a third side and a fourth side, said free end of said first side being adjacent to said third side and said free end of said second side being adjacent to said fourth side; a fifth side and a sixth side each having a common end, said fifth side being adjacent to said third side and extending toward said second side, said sixth side being adjacent to said fourth side and extending toward said first side, and said fifth side and said sixth side converging at said common ends thereof; and said first top surface being coplanar with said second top surface to define a plane and legs for bracing said platform above a ground surface;

placing a first forefoot of a user on said first top surface and placing a second forefoot of said user on said second top surface; and extending the heels of each foot in a direction longitudinally away from the legs of the user through said plane while maintaining both forefeet on the first and second top surfaces; and withdrawing the heels of each foot in a direction longitudinally toward the legs of the user back through and away from said plane while maintaining both forefeet on the first and second top surfaces of said platform.

9. The method of claim 8, wherein said first and second sides of said apparatus define a right angle.

10. The method of claim 8, wherein said fifth and sixth sides of said apparatus define an angular opening.

11. The method of claim 5, wherein said angular protrusion of said apparatus is sufficiently narrow to allow said user to place each foot on said platform perpendicular to each respective one of said first and second sides of said angular protrusion.

12. The method of claim 10, wherein said angular opening of said apparatus is sufficiently wide to allow said user to place each foot on said platform perpendicular to each respective one of said fifth and sixth sides of said angular opening.

13. The method of claim 8, wherein said platform of said apparatus comprises two elongated beams each with a common end and a free end, the common ends of each of said elongated beams joining at a junction to define both an angular protrusion on the outside and an angular opening on the inside of the junction.

14. The method as defined in claim 8, wherein said top of said platform of said apparatus is substantially parallel above a ground surface.

15. A method of exercising the leg comprising the steps of: providing a flat platform with a top surface defining a plane and a plurality of sides, wherein a first side and a second side converge at an angle with respect to each other, the top surface of the platform providing a first surface adjacent said first side and a second surface adjacent said second side; and said platform being supported above a ground surface; placing a first forefoot of a user on said first surface and placing a second forefoot of said user on said second surface; extending the heels of each foot in a direction longitudinally away from the legs of the user through said plane while maintaining both forefeet on the respective first and second surfaces; and withdrawing the heels of each foot in a direction longitudinally toward the legs of the user back through and away from said plane while maintaining both forefeet on the respective first and second surfaces of said platform.

16. The method of claim 15 including the additional step of turning each foot of said user laterally inward, so that the forefeet of both feet are closer together than the heels of both feet before extending the heels of each foot in a direction longitudinally away from the legs of the user.

17. The method of claim 15, including placing each foot substantially perpendicular to each respective side.

18. The method of claim 15 including the additional step of turning each foot of said user laterally outward, so that the forefeet of both feet are farther apart than the heels of both feet before extending the heels of each foot in a direction longitudinally away from the legs of the user.

19. The method of claim 8, wherein said first and second sides of said apparatus define an angular protrusion.

* * * * *